US006436273B1

(12) United States Patent
de Nora et al.

(10) Patent No.: US 6,436,273 B1
(45) Date of Patent: Aug. 20, 2002

(54) DRAINED CATHODE ALUMINIUM ELECTROWINNING CELL WITH ALUMINA DISTRIBUTION

(75) Inventors: Vittorio de Nora, Nassau (BS); Jean-Jacques Duruz, Geneva (CH)

(73) Assignee: Moltech Invent S.A., Luxembourg (LU)

( * ) Notice: Subject to any disclaimer, the term of this patent is extended or adjusted under 35 U.S.C. 154(b) by 0 days.

(21) Appl. No.: 09/636,662

(22) Filed: Aug. 11, 2000

Related U.S. Application Data

(63) Continuation of application No. PCT/IB98/00161, filed on Feb. 9, 1999.

(51) Int. Cl.[7] ..... C25C 3/08; C25C 3/00
(52) U.S. Cl. ..... 205/381; 204/245; 204/247
(58) Field of Search ..... 205/381; 204/245, 204/247

(56) References Cited

U.S. PATENT DOCUMENTS 4,505,796 A * 3/1985 Huni et al. ..... 204/243.1
4,602,990 A * 7/1986 Boxall et al. ..... 204/245 X
5,028,301 A * 7/1991 Townsend ..... 204/245 X
5,043,047 A * 8/1991 Stedman et al. ..... 204/243.1 X
5,330,631 A * 7/1994 Juric et al. ..... 204/243.1

* cited by examiner

*Primary Examiner*—Donald R. Valentine
(74) *Attorney, Agent, or Firm*—Jayadeep R. Deshmukh

(57) ABSTRACT

An electrolytic cell for the electrowinning of aluminium comprises a cathode cell bottom provided with a series of sloped active cathode surfaces (11, 12) down which produced aluminium (60) is drained, and a series of recessed grooves or channels (20), below the bottom of the cathode active surfaces (11, 12) and extending therealong which collect and evacuate the drained produced aluminum (63). Preferably the active surfaces (11, 12) are V-shaped and the recessed grooves or channels (20) are provided with a sloping bottom and a constant cross-sectional area. Alumina is so fed into the cell as to supply alumina-rich electrolyte (62) into the recessed grooves or channels (20) which contain the alumina-rich electrolyte along substantially their entire length above the drained layer of aluminium (63). The recessed grooves or channels (20) supply the alumina-rich electrolyte (62) to the bottom part of the active cathode surfaces (11, 12) under the effect of the electrolyte circulation produced by propelling gas (64) released under the anodes.

32 Claims, 5 Drawing Sheets

DRAINED CATHODE ALUMINIUM ELECTROWINNING CELL WITH ALUMINA DISTRIBUTION

This application is a continuation of U.S. designation of PCT/IB98/00161 filed on Feb. 9, 1999.

FIELD OF THE INVENTION

The present invention concerns a drained cell for the electrowinning of aluminium by the electrolysis of alumina dissolved in a fluoride-based molten electrolyte such as cryolite, having means to improve the distribution of dissolved alumina to enable a uniform electrolysis of alumina.

BACKGROUND OF THE INVENTION

The technology for the production of aluminium by the electrolysis of alumina, dissolved in molten cryolite containing salts, at temperatures around 950° C. is more than one hundred years old.

This process, conceived almost simultaneously by Hall and Héroult, has not evolved as much as other electrochemical processes, despite the tremendous growth in the total production of aluminium that in fifty years has increased almost one hundred fold. The process and the cell design have not undergone any great change or improvement and carbonaceous materials are still used as electrodes and cell linings.

A major drawback of conventional cells is due to the fact that irregular electromagnetic forces create waves in the molten aluminium pool and the anode-cathode distance (ACD), also called inter-electrode gap (IEG), must be kept at a safe minimum value of approximately 50 mm to avoid short circuiting between the aluminium cathode and the anode or re-oxidation of the metal by contact with the $CO_2$ gas formed at the anode surface.

Drained cell designs have been proposed to avoid the problems of conventional cells, by replacing the pool with a thin layer of aluminium which is drained down the surface of the cathode, enabling the Anode-Cathode Distance to be significantly reduced.

U.S. Pat. No. 4,560,488 (Sane/Wheeler/Kuivila) proposed a drained cathode arrangement in which the surface of a carbon cathode block was covered with a sheath that maintained stagnant aluminium on its surface in order to reduce wear. In this design, the cathode block stands on the cell bottom.

U.S. Pat. No. 3,400,061 (Lewis/Altos/Hildebrandt) and U.S. Pat. No. 4,602,990 (Boxall/Gamson/Green/Stephen) disclose aluminium electrowinning cells with sloped drained cathodes arranged with the cathodes and facing anode surfaces sloping across the cell. In these cells, the molten aluminium flows down the sloping cathodes into a median longitudinal groove along the centre of the cell, or into lateral longitudinal grooves along the cell sides, for collecting the molten aluminium and delivering it to a sump.

An improvement described in U.S. Pat. No. 5,472,578 (de Nora) consisted in using grid-like bodies which could form a drained cathode surface and simultaneously restrain movement in the aluminium pool.

In. U.S. Pat. No. 5,362,366 (de Nora/Sekhar), a double-polar anode-cathode arrangement was disclosed wherein cathode bodies were suspended from the anodes permitting removal and re-immersion of the assembly during operation, such assembly also operating with a drained cathode.

U.S. Pat. No. 5,368,702 (de Nora) proposed a novel multimonopolar cell having upwardly extending cathodes facing and surrounded by or in-between anodes having a relatively large inwardly-facing active anode surface area. In some embodiments, electrolyte circulation was achieved using a tubular anode with suitable openings.

Of course, the active surface of the cathode and of the anode should be at a slope to facilitate the escape of the bubbles of the released gas. Moreover, to have a cathode at a slope and obtain an efficient operation of the cell would be possible only if the surface of the cathode were aluminium-wettable so that the production of aluminium ions would take place on a film of aluminium.

Only recently has it become possible to coat carbon cathodes with a slurry which adheres to the carbon and becomes aluminium-wettable and very hard when the temperature reaches 700–800° C. or even 950–1000° C., as disclosed in U.S. Pat. No. 5,316,718 (Sekhar/de Nora) and U.S. Pat. No. 5,651,874 (de Nora/Sekar). These patents proposed coating components with a slurry-applied coating of refractory boride, which proved excellent for cathode applications. These publications included a number of novel drained cathode configurations, for example including designs where a cathode body with an inclined upper drained cathode surface is placed on or secured to the cell bottom. Further design modifications in the cell construction could lead to obtaining more of the potential advantages of these coatings.

European Patent Application No. 0 393 816 (Stedman) describes another design for a drained cathode cell intended to improve the bubble evacuation. However, the manufacture of the electrodes is difficult since their active surfaces slope along two orthogonal directions of the cell at the same time. Additionally, such a drained cathode configuration cannot ensure optimal distribution of the dissolved alumina.

U.S. Pat. No. 5,683,559 (de Nora) proposed a new cathode design for a drained cathode, where grooves or recesses were incorporated in the surface of blocks forming the cathode surface in order to channel the drained product aluminium. A specific embodiment provides an enhanced anode and drained cathode geometry where aluminium is produced between V-shaped anodes and cathodes and collected in recessed grooves. The V-shaped geometry of the anodes enables on the one hand a good bubble evacuation from underneath the anodes as described in the prior art, and on the other hand it enables the drainage of produced aluminium from cathode surfaces into recessed grooves located at the bottom of the V-shapes.

Whereas conventional cells having an aluminium pool motion require a greater Anode-Cathode Distance to prevent short-circuits between the electrodes, such pools provide sufficient motion in the electrolytic bath to distribute the dissolved alumina over the cathode. Conversely, drained cells have a reduced Anode-Cathode distance but do not have an aluminium pool motion that stirs and distributes alumina-rich electrolyte between the electrodes.

Because drained cells lack stirring means to distribute alumina-rich electrolyte in the Inter-Electrode Gap, areas of the cathodes which are close to the feeding point of alumina into the electrolyte contain greater amounts of alumina than remote areas.

Most of the alumina is electrolysed on the parts of the cathodes close to the dissolution point, whereas remote areas of the cathodes are poorly fed with alumina. This is due to the gradual depletion of the alumina concentration in the electrolyte while the electrolyte is moving between the electrodes where its electrolysis takes place. Consequently, such a gradient of dissolved-alumina concentration over the cathode of a drained cell can cause a non-uniform use of the active surfaces of the cathodes and therefore a non-uniform consumption of the electrodes while increasing the risk of a local anode effect due to a locally insufficient electrolysis of alumina.

While the foregoing references indicate continued efforts to improve the operation of molten cell electrolysis operations, none suggests a design improving the distribution of the dissolved alumina over the whole active surface of a drained cathode configuration.

SUMMARY OF THE INVENTION

It is therefore an object of the invention to provide a drained cell for the electrowinning of aluminium by the electrolysis of alumina dissolved in a fluoride-based melt such as cryolite, designed to ensure an enhanced distribution of alumina dissolved in electrolyte between the active sloping surfaces of the electrodes.

Another object of the invention is to provide a regular flow of the electrolyte containing $CO_2$ gas towards the gap between the anodes and the subsequent return of electrolyte to the bottom at the lowest point of the anode surface where the alumina-rich electrolyte is formed.

The invention in particular relates to an electrolytic cell for the electrowinning of aluminium from alumina dissolved in a fluoride-based molten electrolyte. Such cell comprises:

a) a cathode cell bottom comprising at least one sloped active cathode surface, and at least one recessed groove or channel below the bottom of the cathode active surface and extending therealong, the active cathode surface forming a drained cathode on which a layer of molten aluminium is produced and continuously drained into the recessed groove or channel;

b) at least one anode having sloped active anode surface facing the active cathode surface; and When such cell is in use an electrolyte circulation is at least partly driven by gas released during the electrolysis between the sloped anode and cathode active surface.

The cell is characterized in that the means for feeding alumina are arranged such that alumina-rich electrolyte is fed into the or each recessed groove or channel which is arranged for the fed alumina-rich electrolyte to circulate longitudinally therein along substantially its entire length aboe the drained layer of aluminium. The recessed groove or channel further forms means for supplying the alumina-rich electrolyte to the bottom part of the or each active cathode surface under the effect of the electrolyte circulation produced by gas release.

In contrast to the prior art, the alumina enriched electrolyte is distributed over substantially the whole bottom end of the sloped active surface of the cathode.

The purpose of this invention is to supply the whole bottom part of the sloped cathode with alumina-rich electrolyte. To achieve this, the recessed groove or channel provides a sufficient flow of alumina-rich electrolyte to the active surfaces of the electrodes and additionally protects the supplied alumina-rich electrolyte from being electrolysed and depleted before it reaches the active surfaces where it is then electrolysed.

The recessed grooves or channels may be of any shape providing therein a sufficient electrolysis-free area for the required flow of alumina-rich electrolyte to the active surfaces of the electrodes. They may for instance be of constant section having a horizontal bottom, and therefore provide the active surfaces of the cathode bottom with a uniform flow of electrolyte from the recessed grooves or channels along the whole length thereof.

In order to enable an optimal draining of the product aluminium, the bottom of the recessed grooves or channels is preferably sloped.

Combining the two criteria described hereabove, a preferred geometry for each recessed groove or channel is a sloping bottom and a constant cross-sectional area along its length.

The above mentioned U.S. Pat. No. 5,683,559 (de Nora) describes in one embodiment a similar cathode bottom having sloped active surfaces and further provided with an aluminium collecting recessed groove along the bottom of the V-shaped surfaces of the cathode bottom and extending below the bottom of the sloped cathode surfaces. In contrast, the recessed grooves or channels of this invention must be drained or at least contain so little aluminium as to leave enough space above the level of the collected aluminium to allow a sufficient electrolyte circulation atop the collected drained aluminium within the recessed grooves or channels. Furthermore, such a recessed groove or channel provides an electrolysis-free electrolyte circulation wherein the supplied alumina-rich electrolyte is protected from the electrical current passing from the anodes to the cathode bottom.

In order to facilitate aluminium collection from the cell, cross-channels to which the recessed grooves or channels lead may be provided in the cell bottom. Such cross-channels are preferably located at the same level or below the level of the recessed grooves or channels to ensure an optimal evacuation of the product aluminium into the cross-channels and prevent the formation of thick layers of aluminium in the recessed grooves or channels. When the bottom of the recessed grooves or channels is sloping, such cross-channels are to be located at the lower end of said sloping bottoms. The bottom of the cross-channels is preferably sloping to facilitate aluminium evacuation.

Furthermore, the junctions between the cross-channels and the recessed grooves or channels can be advantageously used to locate alumina feeding points. However, it is not necessary to have alumina fed directly in front of the end opening of the recessed grooves or channels. Alumina can be fed anywhere where it is not subjected to immediate electrolysis but from where the alumina-rich electrolyte can reach the recessed grooves or channels before being exposed to the electrolysing electrical current.

The sloped active surfaces of the electrodes may be arranged freely provided the following conditions are met. Firstly, the sloping active surfaces should be so designed as to allow the produced gas accumulated in the form of bubbles under the anode active surfaces facing the cathode bottom to move freely along the anode bottom towards the surface and escape from there.

Additionally, in order to prevent over-depletion of the alumina-rich electrolyte during its electrolysis between the electrodes before it reaches the end of the active surfaces moved by the escaping gas bubbles, the length to be covered by the electrolyte between the electrodes should be reasonably short. This also offers the advantage of preventing the accumulation of gas into large bubbles.

For ease of manufacturing the cell, the sloping active cathode surfaces preferably form a series of juxtaposed V-shapes.

The cathode bottom of a cell according to the invention can be made of blocks having active sloped cathode surfaces, a bottom surface, a front surface, a back surface and two lateral surfaces. Such blocks may, for instance, comprise two V-shaped sloping active cathode surfaces and a recessed groove or channel below the bottom of the cathode active surfaces and extending therealong. Another possible design is a block comprising two roof-shaped sloping active cathode surfaces, each surface provided with a cut-out or a bevel below the bottom of the cathode active surfaces and extending therealong, so that a recessed groove or channel is formed between two laterally juxtaposed blocks. Alternatively this roof-shaped block can be obtained from the lateral juxtaposition of two part-blocks, each provided with only one sloping active surface and one cut-out or a bevel.

Such cathode blocks are advantageously provided with a grove or like recess in their bottom and extending therealong for receiving a steel or other conductive bar for the delivery of current. The groove is generally parallel to the active and lateral surfaces of the cathode block.

Normally the cathode blocks are made of carbon or carbonaceous material such as compacted powdered carbon, a carbon-based paste for example as described in U.S. Pat. No. 5,413,689 (de Nora/Sekhar), prebaked carbon blocks assembled together on the shell, or graphite blocks, plates or tiles.

It is also possible for the cathode to be made mainly of an electrically-conductive carbon-free material, of a composite material made of an electrically-conductive material and an electrically non-conductive material, or of an electrically non-conductive material.

Carbon-free materials can be alumina, cryolite, or other refractory oxides, nitrides, carbides or combinations thereof. Carbon-free conductive materials is preferably chosen among Groups IIA, IIB, IIIA, IIIB, IVB, VB and the Lanthanide series, in particular aluminium, titanium, zinc, magnesium, niobium, yttrium or cerium, and alloys and intermetallic compounds thereof.

The composite material's metal preferably has a melting point from 650° C. to 970° C.

The composite material is advantageously a mass made of alumina and aluminium or an aluminium alloy, see U.S. Pat. No. 4,650,552 (de Nora/Gauger/Fresnel/Adorian/ Duruz), or a mass made of alumina, titanium diboride and aluminium or an aluminium alloy.

The composite material can also be obtained by micropyretic reaction such as that utilising, as reactants, $TiO_2$, $B_2O_3$ and Al.

The cathode can also be made of a combination of at least two materials from: at least one carbonaceous material as mentioned above; at least one electrically conductive non-carbon material; and at least one composite material of an electrically conductive material and an electrically non-conductive material, as mentioned above.

In any case a cell according to the invention is preferably provided with dimensionally stable anodes and cathodes. The anodes may for instance be made of non-carbon and substantially non-consumable material.

Advantageously the cathode surface is coated with an aluminium-wettable refractory material, such as a refractory hard metal boride. Particulate refractory hard metal boride may for instance be included in a colloidal carrier and then applied to the cathode surface, i.e. according to the teaching of the aforesaid U.S. Pat. No. 5,651,874 (de Nora/Sekhar).

The anodes of the electrolytic cell can be made of carbon-free material. In any case the anodes are preferably made of substantially non-consumable material.

The invention also relates to a method of electrowinning aluminium in a cell as described above.

The method is characterized in that feeding and dissolution of alumina in the electrolyte is followed by feeding the alumina-rich electrolyte into the or each recessed groove or channel and circulating alumina-rich electrolyte longitudinally in the or each recessed groove or channel aling substantially the entire length of the recessed groove or channel above the drained layer of aluminium. The alumina-rich electrolyte from the recessed groove or channel is then supplied to the bottom part of each active cathode surface under the effect of the electrolyte circulation produced by gas release from where it is distributed over the whole active cathode surface where it is electrolysed.

Alumina-rich electrolyte can be fed in different types of recessed grooves to provide dissolved alumina to the bottom part of the sloped surfaces. For instance, the electrolyte can be fed in at least one recessed groove or channel having a horizontal bottom, a sloped bottom or a bottom having a constant cross-sectional area along its length among many other possible shapes.

Aluminium produced on the active surfaces of the cathodes and drained into the recessed grooves or channels can be advantageously evacuated in at least one cross-channel preferably collecting aluminium from a plurality Furthermore, fresh alumina can be fed at the junctions between the recessed grooves or channels and the cross-channels. Thus, alumina is dissolved closely to the recessed electrolyte supply grooves or channels.

As stated earlier, aluminium is preferably produced on sloping active cathode surfaces forming a series of juxtaposed V-shapes for ease of manufacturing the cathode cell bottom.

The electrolytic cell of the invention can either be obtained from a used conventional cell which is converted to the invention or a new cell specially designed for the purpose of the invention. In any case the manufacturing of the cell usually comprises providing channels, grooves, bevels, sloping sections or cut-outs in the top surface of the cathode bottom of the cell before or after assembly of the components of the cell. The channels or grooves or sloping sections can be machined in the top surfaces of the cathode bottom of the cell.

DESCRIPTION OF THE DRAWINGS

Reference is made to the drawings wherein.

DETAILED DESCRIPTION OF THE INVENTION

Figure 1:
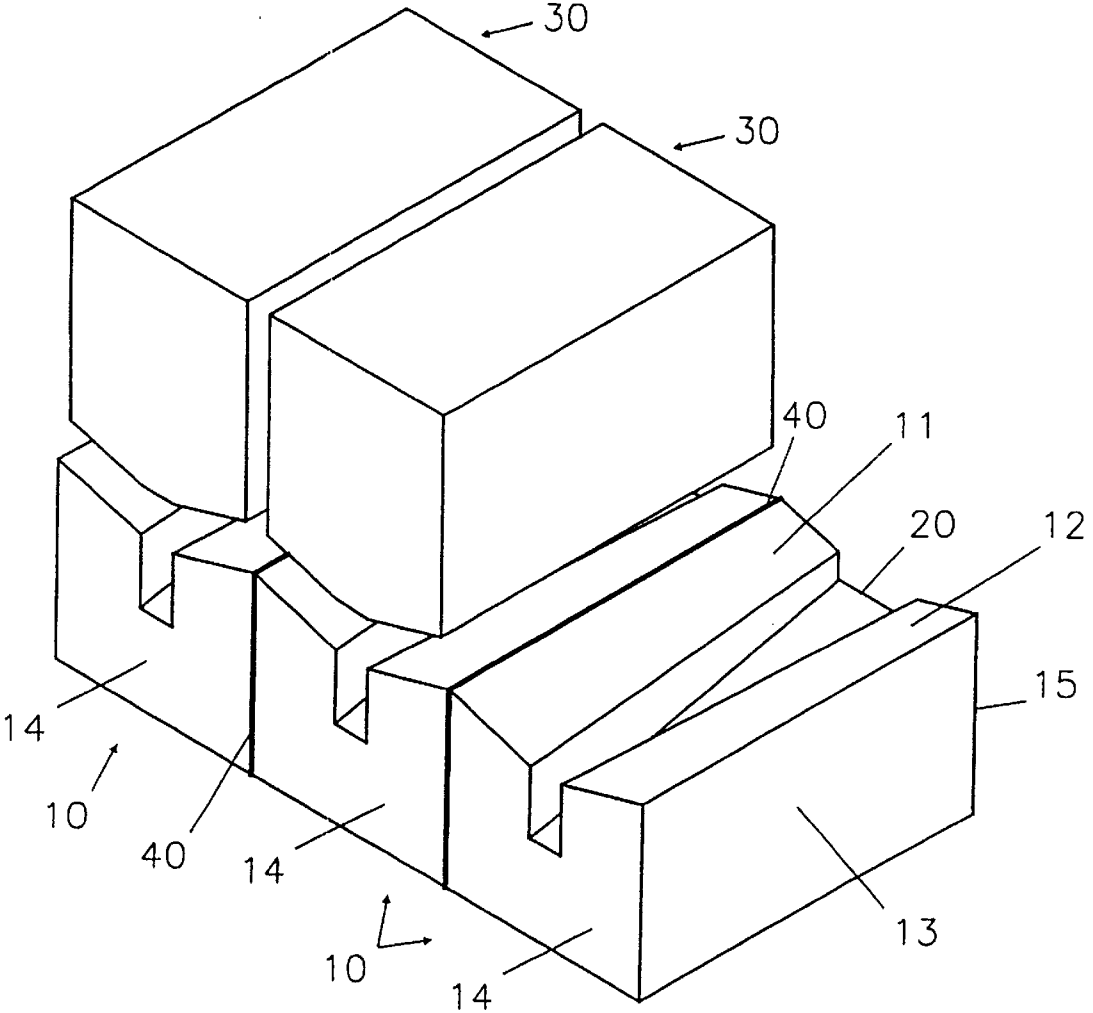
FIG. 1 is a perspective view of part of a cell bottom formed of cathode blocks having V-shaped top surfaces covered with facing anodes, three such cathodes and two anodes being shown.

FIG. 1 schematically shows part of a cell bottom according to a preferred embodiment of the invention formed of an assembly of cathode blocks 10, three cathode blocks being shown, with two facing anodes 30. The cathode blocks 10 are generally rectangular and in this example are made of carbon in the form of anthracite or graphite of the normal grade used for aluminium production cathodes.

The cathode blocks 10 have V-shaped top surfaces 11,12 (which will form the cathode cell bottom) side surfaces 13 (which will be joined together), a front surface 14, a back surface and a bottom surface. The V-shaped top surfaces 11,12 are provided with a sloping recessed groove 20 along their bottom the section of which is of constant area. The V-shaped surfaces 11,12 and the recessed grooves 20 are machined.

The adjacent blocks 10 are joined side-by-side by ramming paste 40, for example an anthracite-based paste, to form a continuous carbon cell bottom. Instead of using ramming paste, the blocks 10 can advantageously be bonded by a resin-based glue, in which case the gap between the adjacent blocks would be much smaller.

In operation of the cell of FIG. 1, alumina is fed in front of the cathode block front surfaces 14 where it is dissolved in the molten electrolyte. The alumina-rich electrolyte circulates along the whole length of the recessed grooves or channels 20 from where it feeds the bottom part of the sloped active cathode surfaces 11,12. From the bottom of the active surfaces 11,12 the electrolyte moves to the top where it is gradually electrolysed driven by the simultaneously produced gas which escapes towards the surface of the electrolytic bath. The electrolysed alumina-depleted electrolyte then circulates back to the feeding point. The produced aluminium on the active cathode surfaces 11,12 is gravitationally drained from the active surfaces into the recessed grooves or channels 20 where it is collected and evacuated. On the sloping cathode surfaces 11,12 and in the recessed grooves or channels 20, the produced aluminium flows in the direction opposite the electrolyte motion.

Figure 2:
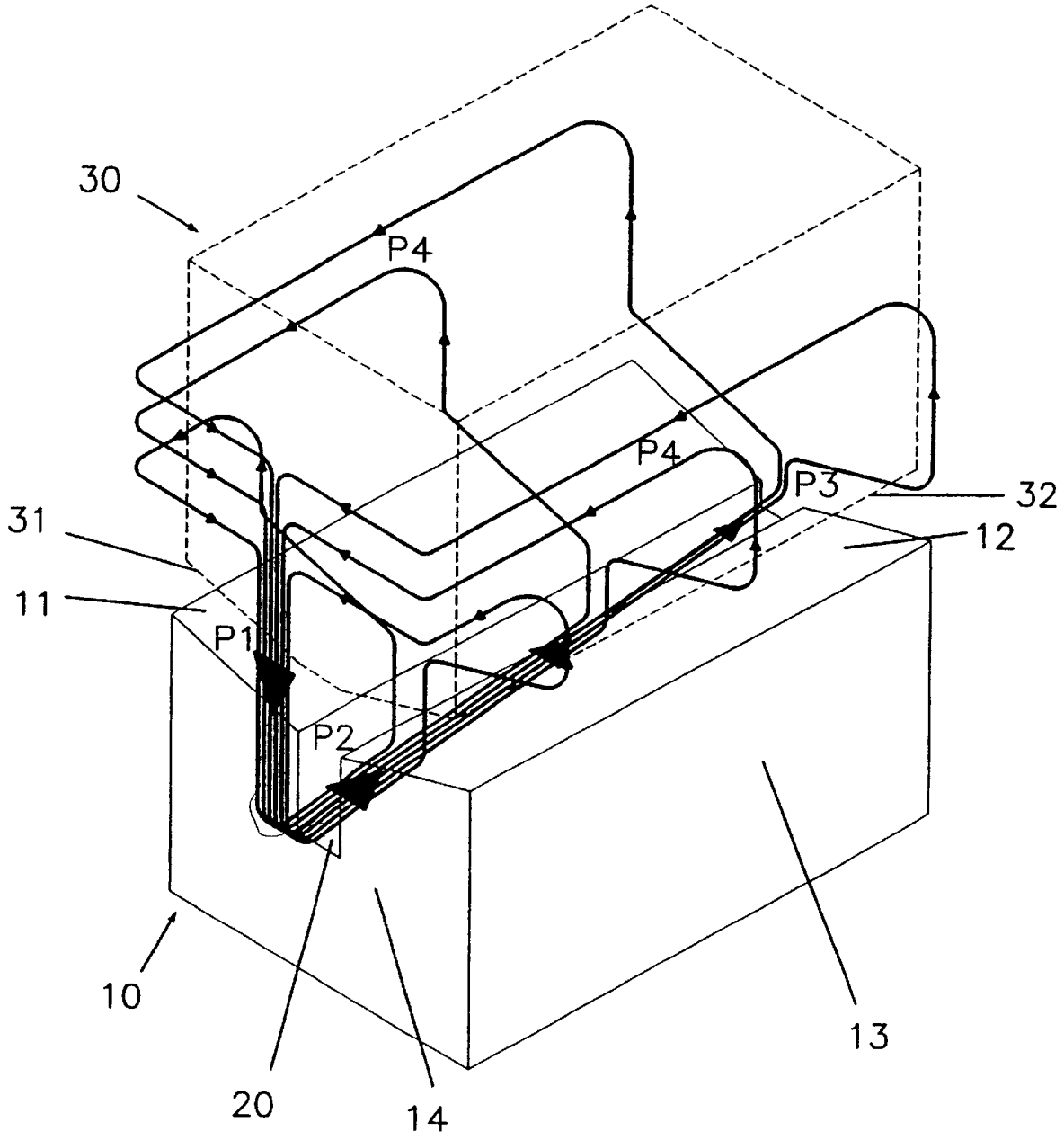
FIG. 2 is a schematic perspective view of the electrolyte circulation between and around a cathode and a facing anode of the type shown in FIG. 1.

FIG. 2 shows schematically the principle of the flow of the electrolyte between and around the electrodes 10,30. Electrolyte circulates from the feeding point P1 along the recessed groove or channel 20 from P2 to P3. Along the whole length of the recessed groove or channel 20, electrolyte is drawn up over the edges of the recessed groove or channel to the V-shaped surfaces of the cathodes 11,12. The electrolyte then follows the inter-electrode gap up the V-shaped surfaces 11,12 until it reaches the upper edges of the cathode 10. Finally the electrolyte leaves the inter-electrode gap to return to the feeding point P1 along the sides P4 of the electrodes 10,30.

The circulation of the electrolyte is propelled by the escaping bubbles generated by gas release at the active anode surfaces 31, 32 during the electrolysis of alumina. Such generated bubbles follow the inclined surfaces of the anodes 31,32 in an ascending motion, providing the necessary forces to move the electrolyte. The inter-electrode gap is fed with alumina-rich electrolyte from the recessed groove or channel 20 drawn in by the upward circulation of electrolyte propelled by the escaping gas.

The recessed groove or channel 20 is fed with alumina-rich electrolyte from the electrolyte at the alumina dissolution point P1 in front of the front surface 14 of the cathode. The concentration of dissolved alumina is substantially uniform in the recessed groove or channel 20 since no electrolysis takes place therein. Alumina-depleted electrolyte which has been electrolysed between the electrodes 10,30 is circulated back to the alumina feeding point P1.

While electrolyte is driven between the electrodes 10,30 by the motion of gas bubbles generated by the electrolysis of alumina, the produced aluminium flows down the V-shaped drained surfaces of the cathode 11,12 into the recessed groove or channel 20 where it is collected and evacuated along its sloped and drained bottom. On the sloping cathode surfaces 11,12 and in the recessed grooves or channels 20, the produced aluminium is gravitationally driven along the opposite direction of the moving electrolyte which is drawn by escaping gas.

Figure 3A:
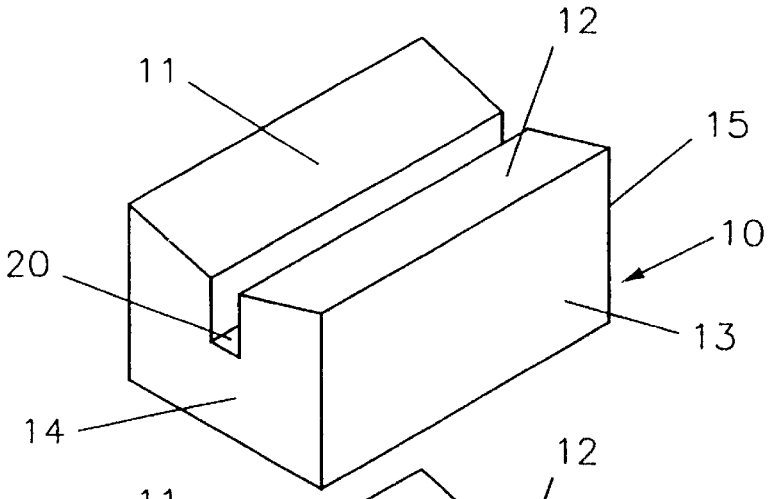
FIGS. 3(*a*), (*b*) and (*c*) are perspective views of cathode blocks having different types of recessed grooves or channels.
Figure 3B:
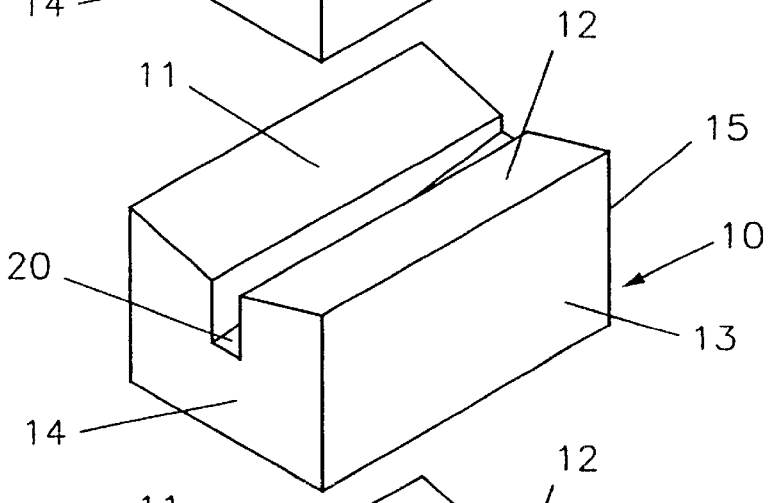
Figure 3C:
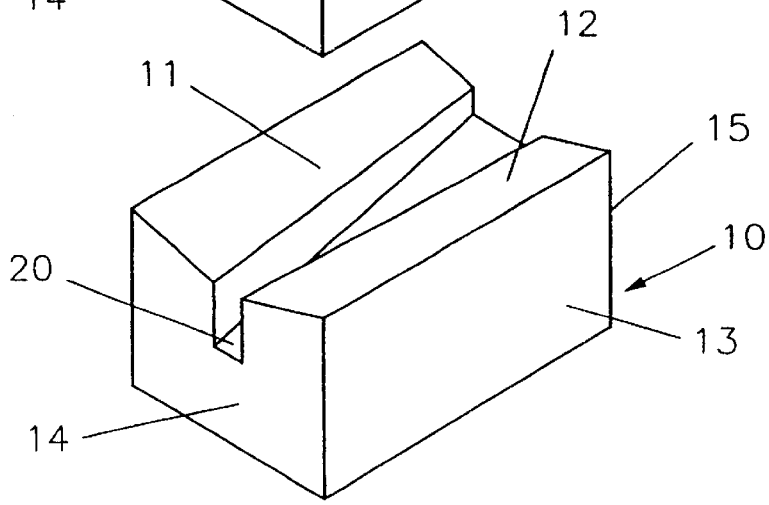

FIG. 3 shows three similar cathode blocks 10 but provided with different recessed grooves or channels 20, which blocks 10 can be assembled into a cell bottom using glue or ramming paste. A first block 10 FIG. 3(*a*) has a recessed rectangular groove 20 which is deeper than wide and a horizontal bottom. The second block 10 of FIG. 3(*b*) has a groove 20 of uniform width provided with a sloping bottom raising from the front surface 14 to the back surface 15 of the cathode block 10. The third block 10 FIG. 3(*c*), similarly to FIG. 3(*b*), has a sloping groove 20 but combined with a variable width to provide a section of constant area along its length, these shapes being given by way of example among many possible shapes.

In all cases, the active sloping parts of the cathode surfaces 11,12 extend along the top surface of the cathode block 10. All of the described grooves, channels 20 and sloping surfaces 11,12 can easily be machined in the blocks 10, for instance using a milling cutter. Alternatively, it is possible to provide grooves or bevels or other forms of channel by other methods, for example by extrusion.

Figure 4:
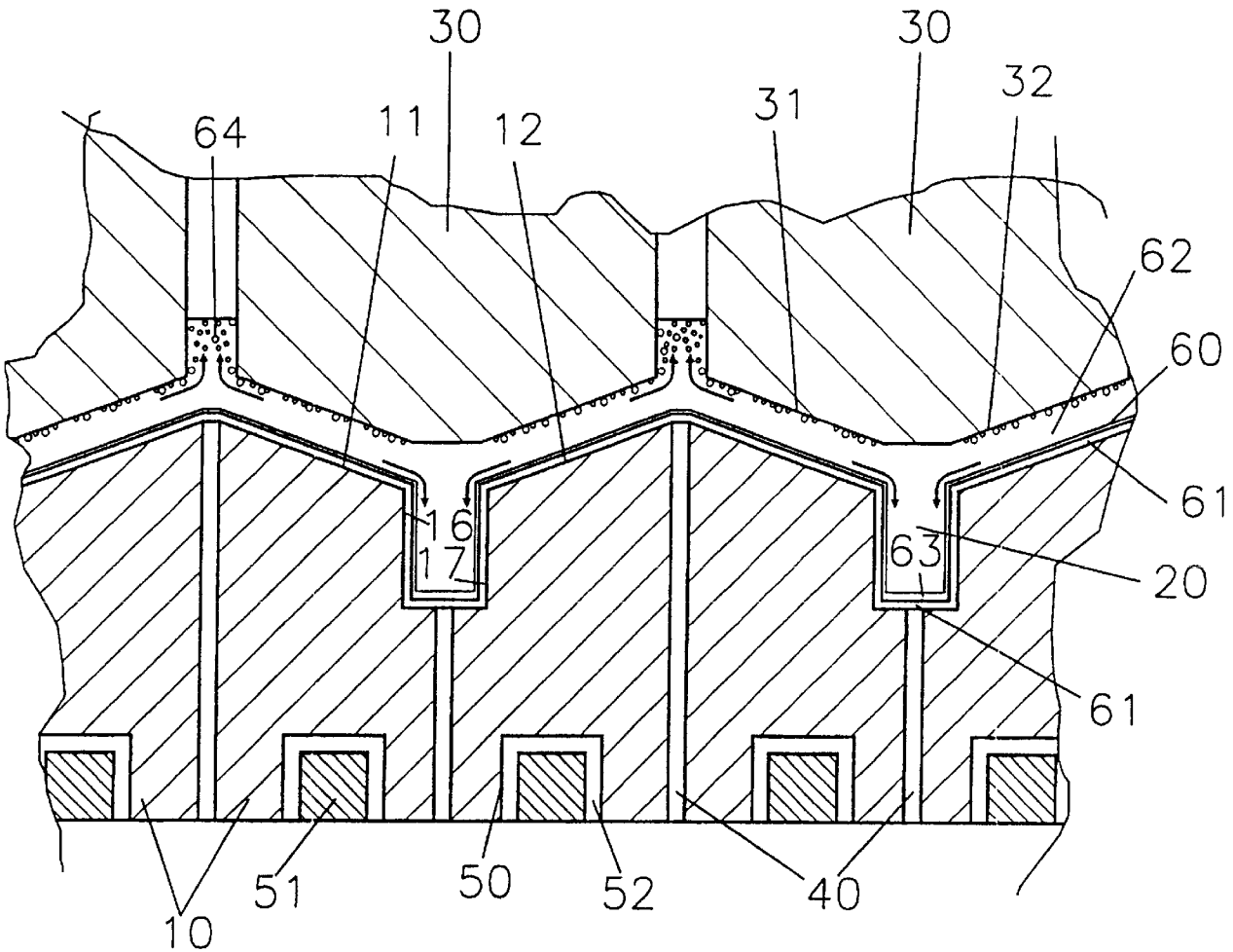
FIG. 4 is a schematic sectional view through part of an aluminium electrowinning cell according to the invention.
Figure 5:
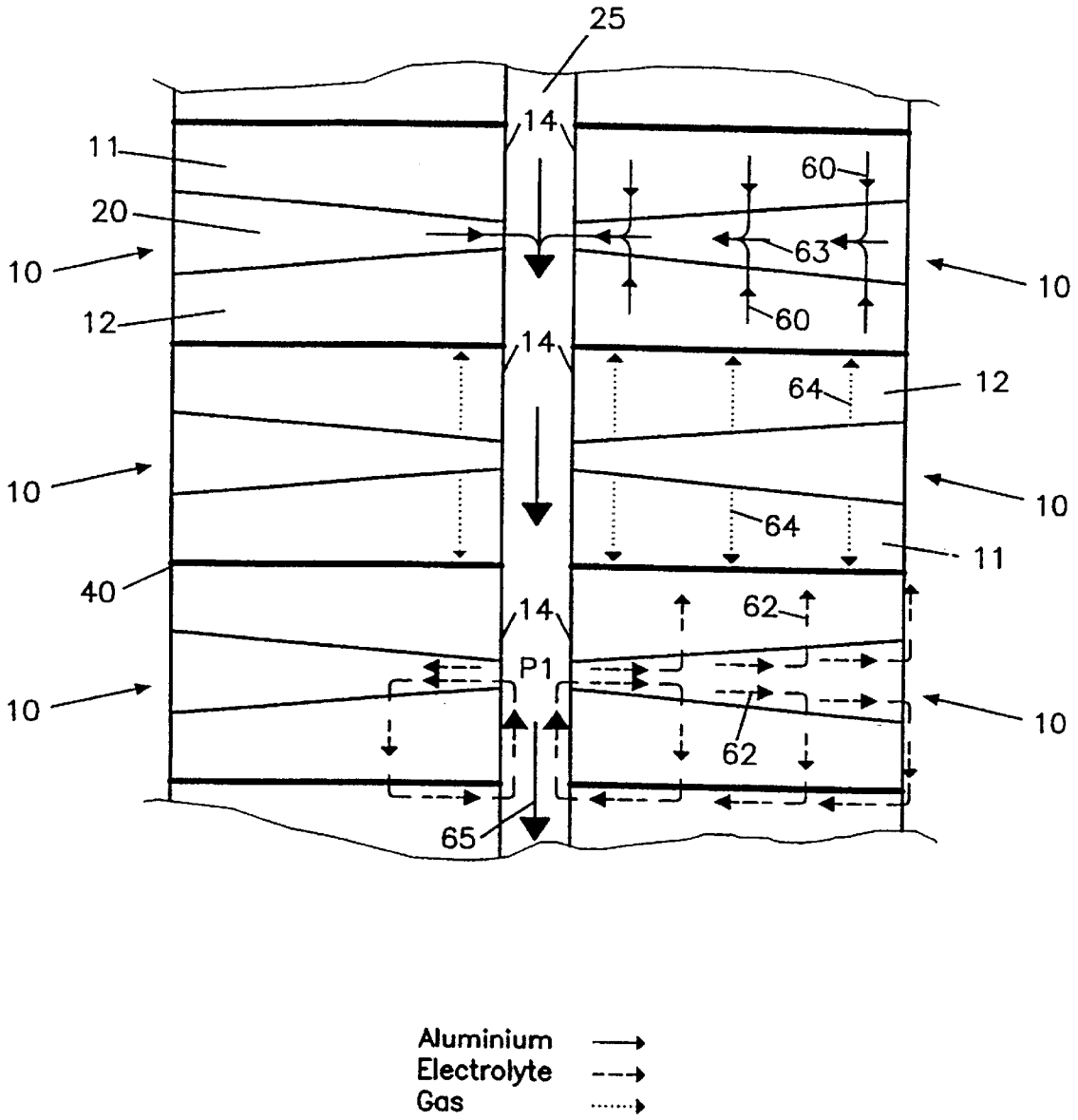
FIG. 5 is a schematic plan view of a drained cathode bottom of a cell similar to the cell shown in FIG. 4 during operation.

FIG. 4 schematically shows, in longitudinal cross-section and side elevation, an aluminium production cell incorporating a carbon cell bottom formed of cathode blocks 10 similar to those described above. A plan view of a similar configuration is shown in FIG. 5. The cathode blocks 10 are arranged side-by-side and extend across the cell. The blocks 10 are connected together by ramming paste 40, or alternatively are glued together, and the endmost blocks are connected by ramming paste to an insert of carbon or a refractory carbide such as silicon carbide at the cell end (not shown). The bottoms of the blocks have recesses 50 receiving steel conductor bars 51 connected in the blocks by cast iron 52, which conductor bars extend externally to a negative bus bar of the cell, situated along the side of the cell.

In contrast to the previously described cathode blocks, the recessed grooves or channels 20 described in this configuration are located between two cathode blocks 10. Such grooves or channels can be obtained from the juxtaposition of two cut-outs 16,17 each located along the lower edge of each cathode top surface 11,12.

The top surfaces 11,12 of the blocks 10 forming the top surface of the carbon cell bottom are advantageously covered with a coating of aluminium-wettable refractory material 61 on which, as shown, there is a layer of drained molten aluminium 60 below a fluoride-based molten electrolyte 62 such as molten cryolite containing dissolved alumina.

Several anodes 30, conventionally blocks of prebaked carbon, are suspended in the cell by the usual mechanisms (not shown) enabling their height to be adjusted. Oxygen evolving non-carbon anodes may be suspended in the cell instead of the carbon anodes but do not need to be vertically adjustable because they are non-consumable. The anodes 30 dip in the molten electrolyte 62 facing the channelled and sloping cathode surfaces 11,12. The anode-cathode gap is not shown to scale. In operation, the cryolite-based electrolyte 62 is usually at a temperature of about 950° C., but the invention applies also to components used in cells with electrolytes well below 900° C., and as low as 700° C.

The surfaces of the cathode blocks 11,12 can be made dimensionally stable by applying a coating of an aluminium-wettable refractory hard metal (RHM) 61 having little or no solubility in aluminium and having good resistance to attack by molten cryolite. Note that the coating 61 also covers the ramming paste 40. Useful RHM include borides of titanium, zirconium, tantalum, chromium, nickel, cobalt, iron, niobium and/or vanadium. Useful cathode materials are carbonaceous materials such as anthracite or graphite.

It is preferred that the cathode blocks 10 of the present invention have a coating 61 of particulate refractory hard metal boride in a colloid according to the teaching of U.S. Pat. No. 5,651,874 (de Nora/Sekhar) which provides a method of applying refractory hard metal boride to a carbon containing component 10 of a cell for the production of aluminium, in particular by the electrolysis of alumina dissolved in a cryolite-based molten electrolyte, this method comprising applying to the surface of the component a slurry of particulate preformed refractory boride in a colloidal carrier as specified above, followed by drying, and by heat treatment before or after the component 10 is installed in the aluminium production cell.

In this patent is described the method of application of the slurry to the cathode blocks 10 of the present invention involving painting (by brush or roller), dipping, spraying, or pouring the slurry onto the cathode blocks 10 and allowing to dry before another layer is added. The coating 61 does not need to be entirely dry before the application of the next layer. It is preferred to heat the coating 61 with a suitable source so as to completely dry it and improve densification of the coating. Heating and drying take place preferably in non-oxidising atmospheres at about 80–200° C., usually for half an hour to several hours and further heat treatments are possible.

The cathode cell bottom may be treated by sand blasting or pickled with acids or fluxes such as cryolite or other combinations of fluorides and chlorides prior to the application of the coating 61. Similarly the cathode cell bottom surface may be cleaned with an organic solvent such as acetone to remove oily products and other debris prior to the application of the coating. These treatments will enhance the bonding of the coatings to the cathode cell bottom.

After coating the cathode blocks 10 by dipping, painting or spraying the slurry or combinations of such techniques in single or multi-layer coatings 61 and drying, a final coat of the colloid alone may be applied lightly prior to use.

Before or after application of the coating 61 and before use, the cathode blocks 10 can be painted, sprayed, dipped or infiltrated with reagents and precursors, gels and/or colloids. For instance, before applying the slurry of particulate refractory boride in the colloidal carrier the cathode blocks 10 can be impregnated with e.g. a compound of lithium to improve the resistance to penetration by sodium, as described in U.S. Pat. No. 5,378,327 (Sekhar/Zheng/Duruz).

To assist rapid wetting of the cathode cell bottom by molten aluminium, the refractory coating 61 on the cathode blocks 10 may be exposed to molten aluminium in the presence of a flux assisting penetration of aluminium into the refractory material, the flux for example comprising a fluoride, a chloride or a borate, of at least one of lithium and sodium, or mixtures thereof. Such treatment favours aluminization of the refractory coating 61 by the penetration therein of aluminium.

In operation of the cell illustrated in FIG. 4, as shown, the coating 61 on the carbon blocks 10 making up the cathode cell bottom is covered by a layer of molten aluminium 60. The recessed channels or grooves 20 in the surface serve to collect the produced aluminium 60 into a drained aluminium film 63. As illustrated, the aluminium layer 60 completely covers the carbon blocks 10 so that the electrolysis takes place between the surface of the aluminium layer 60 and the facing surface of anode 31,32. An advantage is that the ACD can be minimised as there is no aluminium pool between the cell bottom and the anodes 30.

Further illustrated in FIG. 4, as shown, gas in form of bubbles 64 generated from the electrolysis of alumina between the sloped active surfaces of the electrodes 11,12, 31,32 (and therefore not atop the recessed grooves or channels 20) escape towards the surface of the electrolytic bath 62 following the inclined surfaces of the anodes 31,32.

FIG. 5 schematically shows a plan view of part of a cell bottom made of a juxtaposition of blocks 10 as described in FIG. 3(*c*). A cross-sectional view of a similar configuration is shown in FIG. 4. As shown, two groups of three laterally juxtaposed cathode blocks 10 separated by a cross-channel 25 face each other, so that all the front surfaces 14 of the cathode blocks 10 are located next to the cross-channel. The level of the bottom of each recessed groove or channel 20 is such as to allow the drained aluminium evacuated from the recessed grooves or channel 20 to be collected in the cross-channel 25 in form of an aluminium evacuation stream 65. The recessed grooves or channels (20) shown in FIG. 5 are similar to those described in FIG. 3(*c*), however different shapes may be used such as those described in FIG. 3(*a*) and FIG. 3(*b*).

To illustrate operation of the cell of FIG. 5, the different flows of material are shown with different types of arrows. In FIG. 5, for each pair of facing cathode blocks 10 one type of flow is shown. In operation these flows are superposed over all cathode blocks 10.

Dotted arrows illustrate the path of released gas bubbles 64. The gas release starts at each edge of the recessed groove or channel 20 since the electrolysis takes place only between the inclined surfaces 11,12,31,32 of the cathode 10 and the facing anode 30, said path of gas 64 ending at the outer edge of the facing anode 30 (not shown) where it is released into the cell atmosphere.

Dashed arrows show the path of the electrolyte 62. In front of each cathode block 10 the electrolyte 62 is fed with alumina at P1 where it is dissolved and distributed in the different recessed channels or grooves 20. From the electrolyte-supply grooves or channels 20 the alumina-rich electrolyte 62 is drawn by the flow of the released gas 64 over substantially the whole of the cathode active surfaces 11,12 where it is electrolysed. When the electrolyte 62 has passed the inter-electrode gap, where it is depleted in alumina by electrolysis, the alumina-depleted electrolyte flows back to the alumina feeding point P1 for replenishment of this zone with electrolyte.

Further illustrated in FIG. 5 is the produced aluminium flow 60,63,65 shown in full arrows. Aluminium 60 is produced on the cathode cell bottom 11,12 by the electrolysis of alumina at the same time as the released gas 64. The produced aluminium 60, gravitationally driven, flows down the inclined active cathode surfaces 11,12 and is collected in the recessed grooves or channels 20 from where the drained aluminium 63 is gravitationally driven to the cross-channel 25 where it is evacuated in a larger stream 65.

What is claimed is:

1. An electrolytic cell for the electrowinning of aluminium from alumina dissolved in a fluoride-based molten electrolyte, comprising:

a) a cathode cell bottom comprising sloped cathode faces in a generally v arrangement and a recessed groove or channel below adjacent bottom ends of the cathode faces and extending therealong, each sloped cathode face forming a drained cathode surface on which in use a layer of molten aluminium is produced and continuously drained into the recessed groove or channel;

b) sloped anode faces in a generally v arrangement facing and parallel to the sloped cathode faces, each sloped anode face being so arranged that gas released thereon during electrolysis drives at least partly an electrolyte circulation between the facing sloped anode and cathode faces; and c) means for feeding alumina into the circulating electrolyte to enrich it with dissolved alumina;

characterized in that a covering surface located at bottom ends of the sloped anode faces is spaced above and covers the recessed groove or channel such that under the effect of the electrolyte circulation produced by gas release the alumina enriched electrolyte is fed into the covered recessed groove or channel and circulated longitudinally therein along substantially the entire length thereof above the drained aluminium, said covered recessed groove or channel forming means for supplying the alumina-rich electrolyte circulating therealong to and along substantially the entire bottom ends of said sloped cathode faces under the effect of the electrolyte circulation produced by gas release.

2. The electrolytic cell of claim 1, wherein the or each recessed groove or channel has a horizontal bottom.

3. The electrolytic cell of claim 1, wherein the or each recessed groove or channel has a sloped bottom.

4. The electrolytic cell of claim 3, wherein the or each recessed groove or channel has a constant cross-sectional area along its length.

5. The electrolytic cell of claim 1, wherein the or each recessed groove or channel leads to at least one cross-channel for collection of the drained aluminium layer from said recessed groove or channel.

6. The electrolytic cell of claim 5, wherein the or each cross-channel has a sloping bottom.

7. The electrolytic cell of claim 5, wherein the means for feeding alumina into the electrolyte is/are located at or near by at least one junction between said cross-channels with the recessed grooves or channels.

8. The electrolytic cell of claim 1, wherein the sloped cathode faces form a series of juxtaposed V-shapes.

9. The electrolytic cell of claim 1, wherein the cathode bottom is made of blocks having at least one sloped cathode face, a bottom surface, a front surface, a back surface and two lateral surfaces.

10. The electrolytic cell of claim 9, wherein the blocks comprises two V-shaped sloped cathode faces provided with a recessed groove or channel below the bottom of the cathode faces and extending therealong.

11. The electrolytic cell of claim 9, wherein the blocks comprise two roof-shaped sloped cathode faces, each face provided with a cut-out or a bevel below the bottom of the cathode face and extending therealong, so that a recessed groove or channel is formed between two laterally juxtaposed blocks.

12. The electrolytic cell of claim 11, wherein each block consists of a juxtaposition of two part-blocks each comprising one sloped cathode face, so that when the constitutive blocks are laterally juxtaposed their sloped faces form a roof-shape.

13. The electrolytic cell of claim 9, wherein the bottom of the cathode blocks are provided with at least one groove or like recess extending therealong generally parallel to the sloped and lateral faces of the cathode block, for receiving a steel or other conductive or other conductive bar for the delivery of current.

14. The electrolytic cell of claim 9, wherein the blocks comprise carbonaceous material.

15. The electrolytic cell of claim 14, wherein the carbonaceous material is anthracite or graphite.

16. The electrolytic cell of claim 9, wherein the blocks comprise carbon-free material.

17. The electrolytic cell of claim 16, wherein the carbon-free material is selected from alumina, cryolite, refractory oxides, nitrides, carbides and combinations thereof.

18. The electrolytic cell of claim 16, wherein the carbon-free material comprises conductive material.

19. The electrolytic cell of claim 18, wherein the conductive material is selected from at least one metal from Groups IIA, IIB, IIIA, IIIB, IVB, VB, the Lanthanide series, and alloys and intermetallic compounds thereof.

20. The electrolytic cell of claim 19, wherein the metals comprise at least one metal selected from aluminium, titanium, zinc, magnesium, niobium, yttrium, cerium.

21. The electrolytic cell of claim 9, wherein the blocks remain dimensionally stable during electrolysis.

22. The electrolytic cell of claim 1, wherein the cathode cell bottom is coated with a layer of aluminium-wettable refractory material.

23. The electrolytic cell of claim 1, wherein the or each anode is made of carbon-free material.

24. The electrolytic cell of claim 1, wherein the or each anode is made of substantially non-consumable material.

25. A method of electrowinning aluminium from alumina dissolved in a fluoride based molten electrolyte contained in a cell, said cell comprising:

a) a cathode cell bottom comprising sloped cathode faces in a generally v arrangement and a recessed groove or channel below adjacent bottom ends of the cathode faces and extending therealong; and b) sloped anode faces in a generally v arrangement facing and parallel to the sloped cathode faces, said method comprising electrolysing dissolved alumina in the electrolyte between said facing sloped anode and cathode faces to produce on said sloped cathode faces molten aluminium that drains into the recessed groove or channel and to release on said sloped anode faces gas which drives at least partly an electrolyte circulation between said facing sloped anode and cathode faces, and feeding alumina into the electrolyte to enrich it with dissolved alumina, characterized in that a covering surface located at bottom ends of the sloped anode faces is spaced above and covers the recessed groove or channel such that under the effect of the electrolyte circulation produced by gas release the alumina-enriched electrolyte is fed into the covered recessed groove or channel and circulated longitudinally therein along substantially the entire length thereof above the drained aluminium, the alumina-rich electrolyte circulating therealong being supplied to and along substantially the entire bottom ends of the sloped cathode faces under the effect of the electrolyte circulation produced by gas release from where it is distributed over the entire sloped cathode faces where it is electrolysed.

26. The method of claim 25, whereub electrolyte containing dissolved alumina is fed in the or each recessed groove or channel having a horizontal bottom.

27. The method of claim 25, wherein electrolyte containing dissolved alumina is fed in the or each recessed groove or channel having a sloped bottom.

28. The method of claim 27, wherein electrolyte containing dissolved alumina is fed in the or each recessed groove or channel having a constant cross-sectional area along its length.

29. The method of claim 25, wherein the product aluminium is drained from the or each recessed groove or channel into at least one cross-channel for evacuation thereof.

30. The method of claim 29, wherein the product aluminium is drained into the or each cross-channel having a sloping bottom.

31. The method of claim 29, wherein alumina is fed into the electrolyte at or near by at least one junction between said cross-channels with the recessed grooves or channels.

32. The method of claim 25, wherein aluminium is produced on sloped cathode faces forming a series of juxtaposed V-shapes.

* * * * *